US005727487A

United States Patent [19]

Foster et al.

[11] Patent Number: 5,727,487

[45] Date of Patent: Mar. 17, 1998

[54] COMBINING AND BINDING CONVEYOR SYSTEM

[75] Inventors: Wayne G. Foster, Winston-Salem; George D. Nakhle, Pilot Mountain, both of N.C.; Marvin Menzin, Lexington, Mass.; Donald E. Burt, Danvers, Mass.; Henry R. Cofek, Groton, Mass.

[73] Assignee: Design Technology Corporation, Billerica, Mass.

[21] Appl. No.: 537,410

[22] Filed: Oct. 2, 1995

(Under 37 CFR 1.47)

[51] Int. Cl.[6] ..... D05B 25/00; D05B 39/00

[52] U.S. Cl. ..... 112/470.05; 112/470.14; 112/475.07; 112/63; 112/304; 112/155

[58] Field of Search ..... 112/470.14, 470.05, 112/470.06, 470.09, 470.18, 470.36, 475.04, 475.07, 475.09, 63, 304, 155

[56] References Cited

U.S. PATENT DOCUMENTS

| | | | |
|---|---|---|---|
| 1,718,581 | 6/1929 | Rockstroh . | |
| 3,082,717 | 3/1963 | Forte . | |
| 3,588,091 | 6/1971 | Stone, III et al. . | |
| 3,871,312 | 3/1975 | Rockerath et al. . | |
| 4,214,541 | 7/1980 | Zeigler, Jr. et al. . | |
| 4,226,569 | 10/1980 | Gerard et al. . | |
| 4,444,384 | 4/1984 | Keeton . | |
| 4,483,262 | 11/1984 | Keeton . | |
| 4,526,363 | 7/1985 | Fort . | |
| 4,697,837 | 10/1987 | Fort . | |
| 4,856,439 | 8/1989 | O'Neal et al. . | |
| 5,018,715 | 5/1991 | Reeves et al. . | |
| 5,144,873 | 9/1992 | Nasu . | |
| 5,503,095 | 4/1996 | Burt et al. | 112/475.09 X |
| 5,568,780 | 10/1996 | Menzin et al. | 112/470.18 |
| 5,592,890 | 1/1997 | Burt et al. | 112/475.09 X |
| 5,628,264 | 5/1997 | Adamski, Jr. et al. | 112/470.05 |

*Primary Examiner*—Peter Nerbun

*Attorney, Agent, or Firm*—Rhodes Coats & Bennett, L.L.P.

[57] ABSTRACT

A combining and binding conveyor system which combines a first fabric piece and a second fabric piece to form a combined fabric piece, such as a men's brief and applies binding to the fabric piece. The apparatus includes an unique combining fixture for receiving and securing the first fabric piece, the second fabric piece, and the combined fabric piece. A conveyor transports the combining fixture to at least one sewing machine work station having means for operating on the first and second fabric pieces. A transfer station removes the combining fixture from the conveyor when the operations are completed and places the fabric piece on an unique binding fixture for engaging, positioning and securing the fabric piece. The conveyor transports the binding fixture to at least one sewing machine work station for operating on the fabric piece while the same is being held by the binding fixture.

93 Claims, 13 Drawing Sheets

COMBINING AND BINDING CONVEYOR SYSTEM

CROSS REFERENCE TO RELATED APPLICATIONS

This application is related to Applicants' copending application Ser. Nos. 08/183,499 and 07/183,732, both filed Jan. 19, 1994, the disclosures of which are hereby incorporated by reference in their entirety.

BACKGROUND OF THE INVENTION (1) Field of the Invention

The present invention relates generally to a combining conveyor system for assembling fabric pieces, and more particularly, to a combining conveyor system for fabric having a unique combining fixture, binding fixture and a transfer station for moving the fabric piece between each fixture.

(2) Description of the Prior Art

The manufacture of textile clothing articles such as briefs, tee-shirts and outer garments has resisted automation. This is due largely to the difficulty in accurately positioning so called "soft" materials. For example, the knitted material commonly used in briefs and tee-shirts may wrinkle, stick to one another and stretch significantly when handled.

One technique which has been somewhat successful has been the introduction of fiber optic edge detectors. Such detectors, when attached to a sewing machine and guide means can allow some automation of common sewing operations such as binding an edge of a precut fabric piece. However, such operations still require the use of a skilled operator to feed the fabric piece to the sewing machine and usually carry out only one sewing operation at a time.

Thus, there remains a need for a combining conveyor system for assembling fabric pieces for manufacturing fabric assemblies for a men's brief or the like which can be carried out completely automatically without the need for a skilled operator.

SUMMARY OF THE INVENTION

The present invention is directed to a combining conveyor system which combines a first fabric piece and a second fabric piece to form a combined fabric piece, such as a men's brief and applies binding to the fabric piece.

The apparatus includes an unique combining fixture. The combining fixture includes: a base; fabric clamping means for receiving and securing the first fabric piece, the second fabric piece, and the combined fabric piece; and a support attached to the base and supporting the fabric clamping means.

A conveyor transports the combining fixture to at least one sewing machine work station having means for operating on the first and second fabric pieces.

A transfer station removes the combining fixture from the conveyor when the operations are completed and places the fabric piece on an unique binding fixture.

The binding fixture includes: a base; a support attached to the base; and fabric engaging means mounted on the support for engaging, positioning and securing the fabric piece.

The conveyor transports the binding fixture to at least one sewing machine work station for operating on the fabric piece while the same is being held by the binding fixture.

Accordingly, one aspect of the present invention is to provide a combining and binding conveyor system for combining a first fabric piece and a second fabric piece to form a combined fabric piece and to apply a binding to an edge of the fabric piece. The system includes: (a) a combining fixture having means for holding the first fabric piece and the second fabric piece; (b) a upstream conveyor for transporting the combining fixture; (c) at least one work station having means for combining the first and second fabric pieces; (d) a binding fixture for holding the fabric piece; (e) a downstream conveyor for transporting the binding fixture; and (f) at least one work station located adjacent to the conveyor for attaching the binding to the edge of the fabric piece while the same is being held by the binding fixture.

Another aspect of the present invention is to provide a combining and binding conveyor system for combining a first fabric piece and a second fabric piece to form a combined fabric piece and to apply a binding to an edge of the fabric piece. The system includes: (a) a combining fixture having means for holding the first fabric piece and the second fabric piece; the combining fixture including: (i) a base; (ii) fabric clamping means for receiving and securing the first fabric piece; and (iii) a support attached to the base and supporting the fabric clamping means; (b) an upstream conveyor for transporting the combining fixture; (c) at least one work station having means for combining the first and second fabric pieces; (d) a binding fixture for holding the fabric piece; (e) a downstream conveyor for transporting the binding fixture; (f) at least one work station located adjacent to the conveyor for attaching the binding to the edge of the fabric piece while the same is being held by the binding fixture; and (g) a transfer station for removing the combining fixture from the upstream conveyor and for placing the fabric piece on the binding fixture on the downstream conveyor.

Another aspect of the present invention is to provide a combining and binding conveyor system for combining a first fabric piece and a second fabric piece to form a combined fabric piece and to apply a binding to an edge of the fabric piece. The system including: (a) a combining fixture having means for holding the first fabric piece and the second fabric piece; (b) a upstream conveyor for transporting the combining fixture; (c) at least one work station having means for combining the first and second fabric pieces; (d) a binding fixture for holding the fabric piece, the binding fixture including: (i) a base; (ii) a support attached to the base; and (iii) fabric engaging means mounted on the support for engaging, positioning and securing the fabric piece; (e) a downstream conveyor for transporting the binding fixture; (f) at least one work station located adjacent to the conveyor for attaching the binding to the edge of the fabric piece while the same is being held by the binding fixture; and (g) a transfer station for removing the combining fixture from the upstream conveyor and for placing the fabric piece on the binding fixture.

Still another aspect of the present invention is to provide a combining and binding conveyor system for combining a first fabric piece and a second fabric piece to form a combined fabric piece and to apply a binding to an edge of the fabric piece. The system includes: (a) a combining fixture having means for holding the first fabric piece and the second fabric piece; the combining fixture including: a base; fabric clamping means for receiving and securing the first fabric piece, wherein the fabric clamping means includes: (i) a support; (ii) a control arm clamp attached to the support; and (iii) at least one gripping arm, the second fabric piece, and the combined fabric piece formed from the first and second fabric pieces; and a support attached to the base and supporting the fabric clamping means; (b) a upstream conveyor for transporting the combining fixture; (c) at least one work station having means for combining the first and second fabric pieces; (d) a binding fixture for holding the fabric piece, the binding fixture including: a base; a support attached to the base; and fabric engaging means mounted on the support for engaging, positioning and securing the fabric piece, wherein the fabric engaging means includes: (i) clamping means attached to the support; (ii) adjustment means for adjusting the fabric piece to a plurality of horizontal and vertical positions when engaged; and (iii) actuator means for adjusting the adjustment means between the plurality of positions; (e) a downstream conveyor for transporting the binding fixture; (f) at least one work station located adjacent to the conveyor for attaching the binding to the edge of the fabric piece while the same is being held by the binding fixture; and (g) a transfer station for removing the combining fixture from the upstream conveyor and for placing the fabric piece on the binding fixture.

These and other aspects of the present invention will become apparent to those skilled in the art after a reading of the following description of the preferred embodiment when considered with the drawings.

DESCRIPTION OF THE PREFERRED EMBODIMENTS

Figure 1:
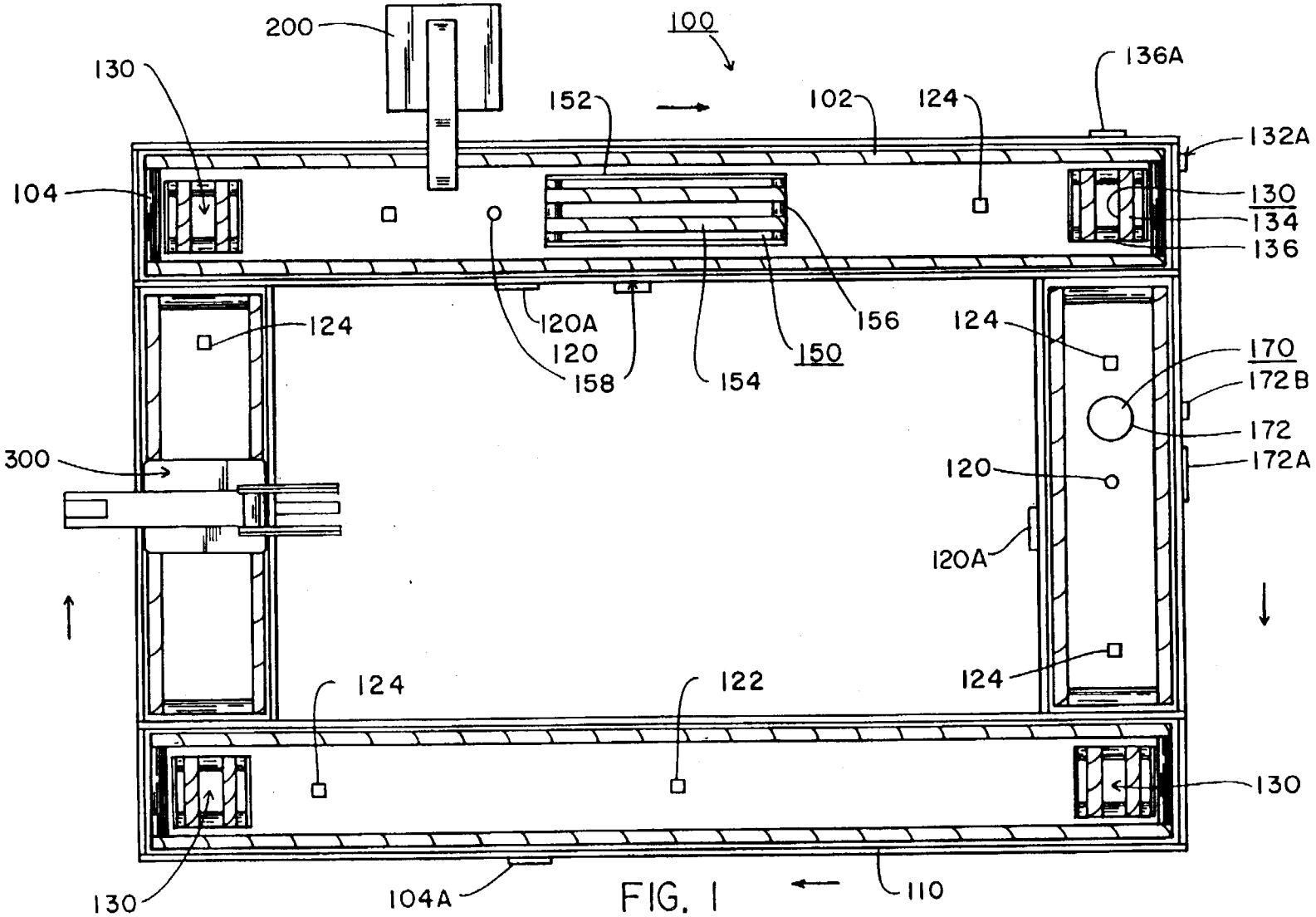
FIG. 1 is a plan view of the combining portion of a conveyor system constructed according to the present invention.
Figure 2:
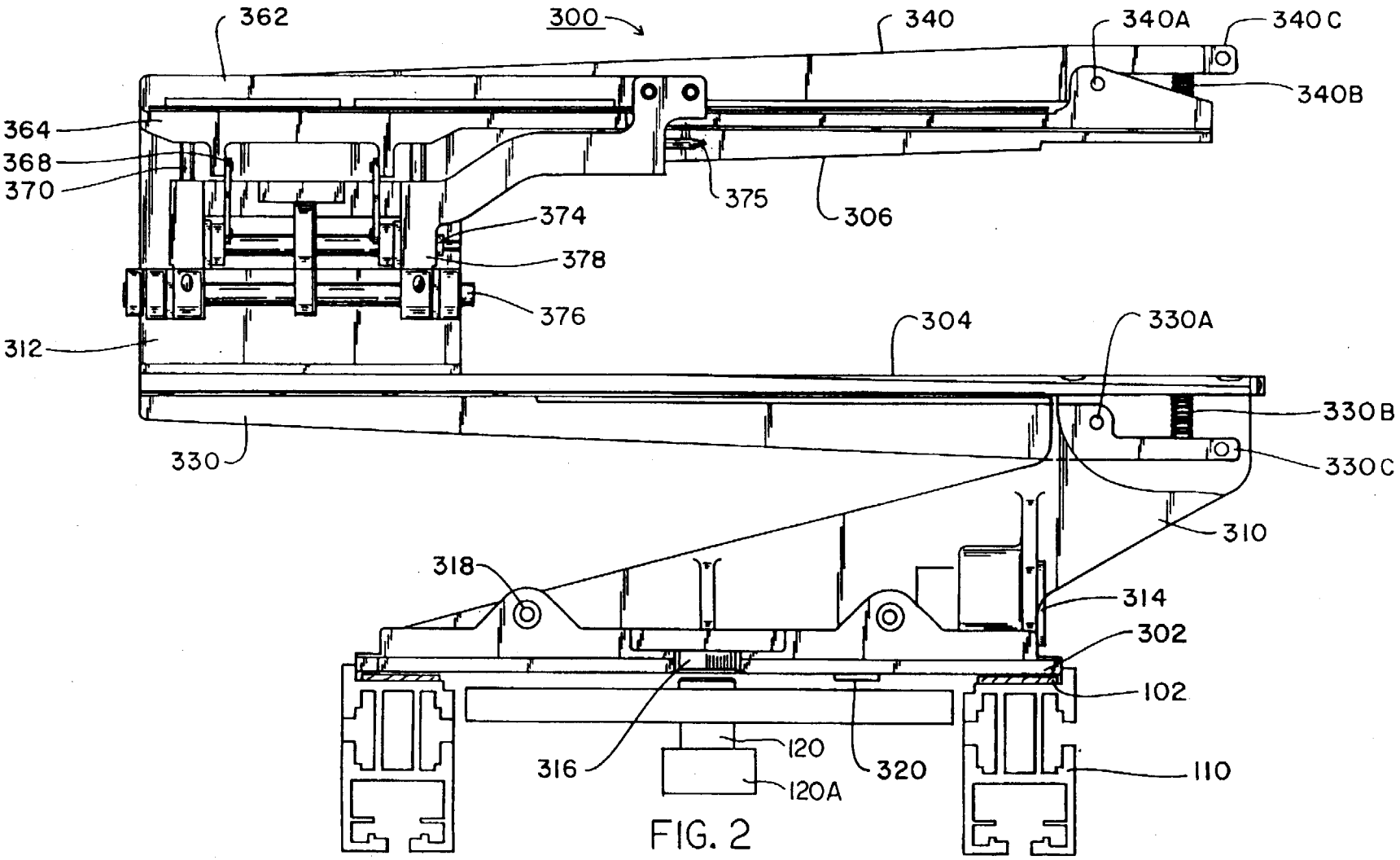
FIG. 2 is a partially fragmented side elevational view of a combining fixture mounted on a conveyor, which forms a part of the present invention.
Figure 3:
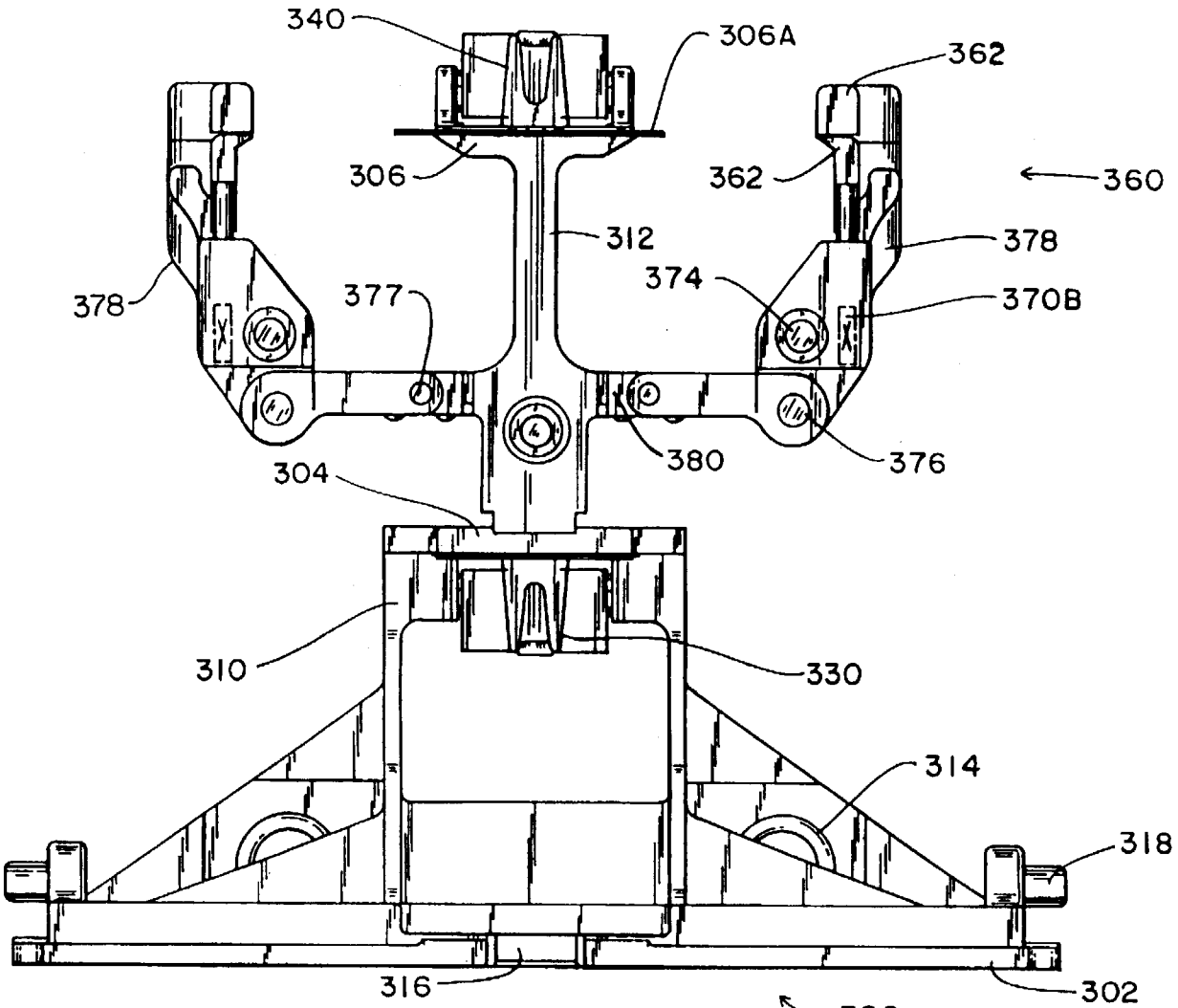
FIG. 3 is an end view of the combining fixture forming a part of the present invention.
Figure 4:
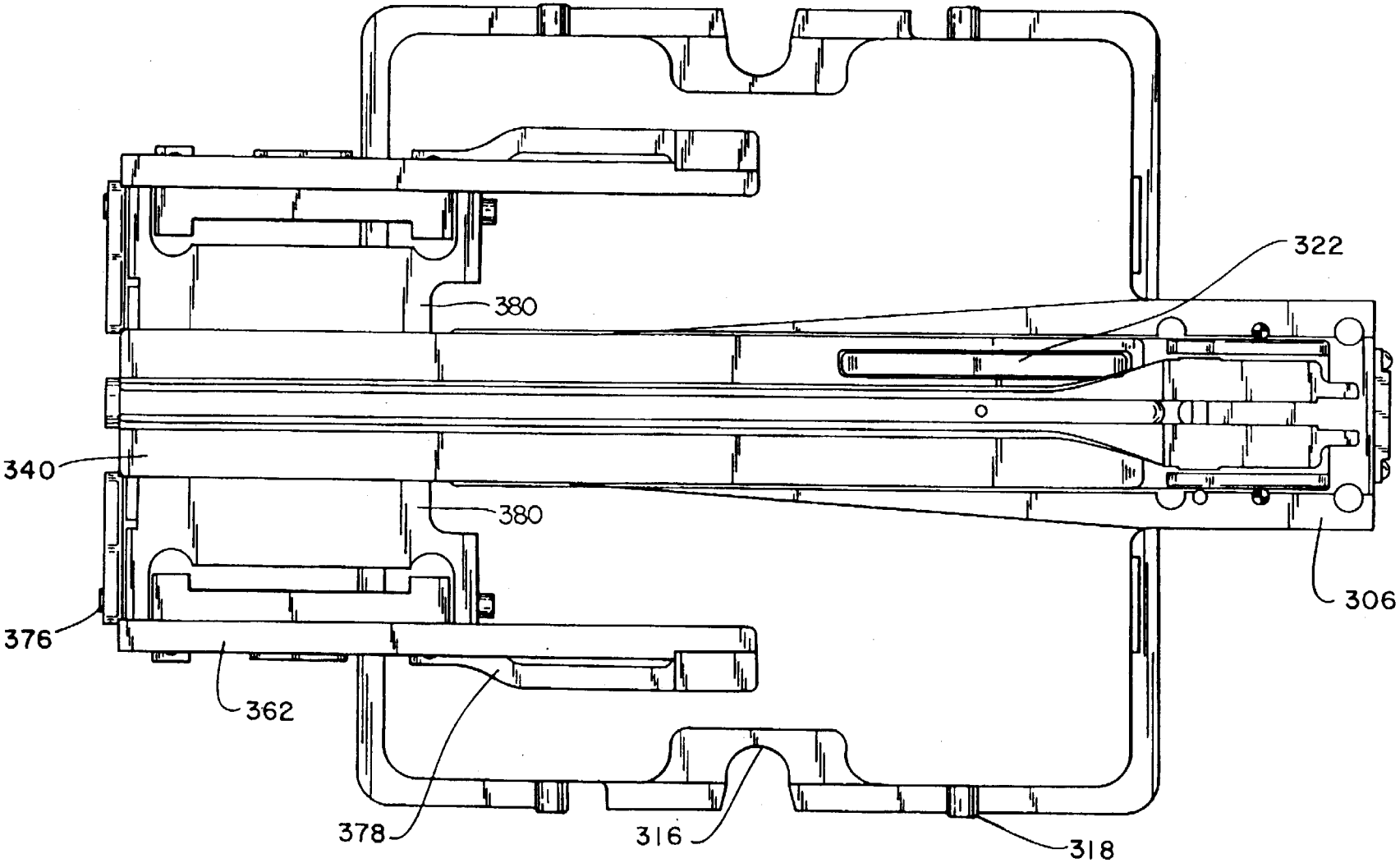
FIG. 4 is a partial top view of the combining fixture forming a part of the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

The present invention provides for automatic handling of fabric pieces and fabrication of garments from the same. While the following description of the preferred embodiment only discloses the operation of combining two fabric pieces, it will be understood that a multiplicity and variety of operations could be performed on the fabric pieces and the resulting garment using the system of the present invention. In describing the preferred embodiment, the process for manufacturing men's briefs underwear will be discussed. However, many similar garment applications will be obvious to those skilled in the art.

Combining Portion

As best seen in FIG. 1, the combining portion of the apparatus of the present invention includes two basic subsystems: an upstream conveyor generally denoted by the numeral 100 and a combining fixture generally denoted by the numeral 300. Also forming a part of the invention is sewing machine 200. While only this single work station is shown, the system of the present invention can easily be designed to accommodate many work stations.

Basic operation of the present invention is as follows. Fixture 300 rides along upstream conveyor 100. Work stations such as sewing machine 200 are located along the path of upstream conveyor 100. As a garment mounted on fixture 300 passes by a work station, it is operated upon. Several features are provided to facilitate the flow of the fixture and the accuracy and efficiency of the operations including lift systems 130, rotators 170, stops 120, secondary conveyors 150, and sensor means 122 and 124. It is particularly noteworthy that a plurality of fixtures can be used at once, and therefore a plurality of garments can be fabricated simultaneously.

Upstream conveyor 100 has frame 110. Mounted on frame 110 are primary belts 102 which ride on a fluorocarbon plastic surface and are driven by primary drive means 104A. These drive means may be servo-controlled or conventional motors, for example, depending on the degree of control needed for the associated operations. Fixture 300, which will be discussed more fully later, has base 302 adapted to ride on upstream conveyor 100 and is guided by frame 110. In operation, fixture 300 travels in a clockwise direction. Lift systems 130 are provided to allow fixture 300 to pass around the corners of upstream conveyor 100 without interference with frame 110.

Lift systems 130 have lift belts 134 which travel on lift rollers 136 and are driven by lift motors 136A. Lift systems 130 also have lift supports which support the aforementioned lift system components and are operatively connected to pneumatic cylinders 132A. When fixture 300 is positioned over a lift system 130, the cylinder is actuated such that the lift support raises and meets the base of fixture 300. Driven lift belts 134 engage fixture 300 and push or pull (depending on whether the lift system is located at the entrance or at the exit of the corner) fixture 300 over frame 110 and onto the adjacent primary belts 102. Position sensors 124 sense the presence of fixture 300 and can thereby provide associated software with the data necessary to determine when fixture 300 is in position to raise the lift support.

Rotator 170 operates much like lift system 130. Position sensor 124 signals the position of fixture 300. Rotator support 172 is raised by a pneumatic cylinder 172B and rotated by a pneumatic actuator 172A. Depending on the desired position of fixture 300 for the next operation, fixture 300 may be rotated 90° or 180°.

When multiple fixtures are used or where speed sensitive operations are implemented, it will be advantageous to control the speed of each fixture. Stops 120 are provided to stop a fixture when desired. Stops 120 are actuated by a pneumatic cylinder 120A in the preferred embodiment and engage stop locator 316 formed in base 302 of fixture 300. Stops 120 can then be retracted to allow fixture 300 to resume travel. Secondary conveyors 150 are provided to either speed up or slow down fixtures on various portions of upstream conveyor 100. Secondary belts 154 are driven by drive means 158 and ride on rollers 156 which are in turn mounted on secondary lift 152. A fixture traveling over a secondary lift is raised off the primary belts and as a result travels at the speed of the secondary belts. This is helpful to ensure a steady and appropriate speed at any given work station, such as a sewing machine, during operation.

Turning now to combining fixture 300, the same is shown in detail in FIGS. 2-4 and 6. Fixture 300 has base 302. Attached to base 302 is lower support 310 which supports lower platform 304 on one end. At the opposite end of the lower platform 304, upper support 312 is attached to and supported by the same. Upper support 312 supports upper platform 306 and gripping arms 360.

Bumpers 318 are mounted on base 302 to protect fixture 300 in case of collisions with other fixtures. An identification badge 320 is affixed to the bottom of base 302 to provide information about the fixture and its associated garment to a scanning device. Identification badge 320 may be a bar code or an electrically encoded tab, for example. Sensor means 122 located on upstream conveyor 100 are designed to read whatever information may be encoded on the identification badge (for example, the size of the brief on the fixture).

Lower clamp arm 330 is pivotally attached to lower platform 304 at pivot **330*a* and is biased against platform 304 by spring 330*b*. Upper clamp arm 340 is pivotally attached to upper platform 306 at pivot 340*a* and is biased against upper platform 306 by spring 340*b***.

Gripping arms 360, generally denoted, are supported by upper support 312. Gripper supports 380 are rigidly affixed to and extend outwardly from supports 312. Gripper sub-frames 378 are pivotally connected to gripper supports 380 at pivots 376 and are held in place by detent systems 377.

Pushing pivot rod 376 forward will cause detent system 377 to disengage, allowing gripper sub-frames 378 to rotate downwardly. Mounted on gripper sub-frames 378 are lower gripper arms 362 and upper gripper arms 364. Linkages 366 are connected to lower gripper arms 362 at pivots 368 and to the control rods 374 such that when rods 374 are rotated, linkages 366 draw lower gripper arms 362 downward. Guides 370 maintain the attitude of lower gripper arms 362 throughout the range of motion. Springs **370*b* bias lower gripper arms 362 upward against upper gripper arms 364**.

Upper clamp arm 340 may be raised by applying a downward force to pivot end **340*c*. Similarly, lower clamp arm 330 may be raised by applying an upward force to pivot end 330*c***.

Fixture 300 may be used as follows to receive and secure two pieces of fabric in order to construct a garment such as a pair of men's briefs.

An external actuator engages pins 375 and pushes pivot rods 376 forward causing detent systems 377 to disengage, thereby allowing gripper sub-frames 378 to be rotated downward. After gripper sub-frames 378 are rotated, then lower and upper gripper arms 362 and 364 are separated by rotating control rod 374. Gripper arms 362 and 364 are now positioned to receive fabric hanging vertically. An external apparatus can be used to insert the fabric. Control rods 374 are then released, allowing gripper arms 362,364 to close so that now the two ends of the fabric are held by the gripper arms. The gripper sub-frames 378 are then rotated upward about pivot 376. The ends of the fabric are now held horizontally by the gripper arms, which is the preferred position for sewing and trimming operations.

Simultaneous with the opening of the gripper arms, lower clamp arms 330 and upper clamp arms 340 are raised by pressing pivot ends **330*c* and 340*c*, respectively. The front fabric panel is then inserted between upper clamp arm 340 and upper platform 306. The pivot end 340C is then released, allowing upper clamp arm 340 to pin down the front panel. Likewise, the center portion of the back panel is inserted between lower clamp arm 340 and lower platform 304 along with being inserted into the openings of gripper arms 362, 364. Pivot end 330C is then released and the back panel is secured by lower clamp arm 330 and lower platform 304**.

Once mounted in the fixture as described above and shown in FIG. 6, the panels are in the preferred position. All of the critical edges of fabric are accurately located, firmly secured, and held such that they can be easily accessed and manipulated.

Transfer Station

A further benefit of fixture 300's design is that it facilitates use of a transfer station, generally denoted as 400, which forms a part of the present invention. The basic purpose of the transfer station is to remove a combined front and back panel from fixture 300 and hold the fabric such that it can be subsequently operated on in the binding fixture 600 (see below).

Transfer station 400 has a rotatable mast 402. Mast 402 is mounted by rotational pivot 406 onto base 407, which is in turn fixedly mounted onto table 409. Rotator motor 411 is operatively connected to turn mast 402. Lift assemblies, denoted generally 410, are mounted on mast 402 by braces 404. Braces 404 are vertically slidable along tracks 401 formed in mast 402.

Lift assemblies 410 have carriages 412 formed thereon. Eight clamp arms 414 depend from each of carriages 412 in four sets of opposed pairs. Each clamp arm 414 has foam backing 414A located on the surface facing its opposing clamp arm 414. Clamp arm actuator means 416 mounted on carriages 412 are operatively connected to clamp arms 412 and are designed to move the same between an open position and a closed position. In the closed position, the foam backing 414A on each clamp arm 414 is pressed against the foam backing of the opposing clamp arm 414. In the open position, the clamp arms are separated.

A pivot assembly, generally denoted 460, has platform 462, which is securely mounted on 409. Pivot point 464 is slidably mounted on platform 462 and pivotly holds base 470. Support 472 extends upwardly from base 470 and supports engagement rods 466, upper release actuator 467, lower release actuator 469, fixture latch 474 and actuator rods 468. Engagement rods 466 are designed to be inserted into the transfer engagement bushings 314 of combining fixture 300 and are adequately sturdy to lift the fixture. Actuator rods 468 are designed to engage the ends Of control rods 374 and rotate the same, such that gripper arms 362 and 364 are opened and closed. Upper and lower release actuators 467 and 469 are designed to engage the ends 340C,330C of upper and lower clamp arms 340 and 330 and fixture latch 474 to secure the fixture during rotation.

Figure 5:
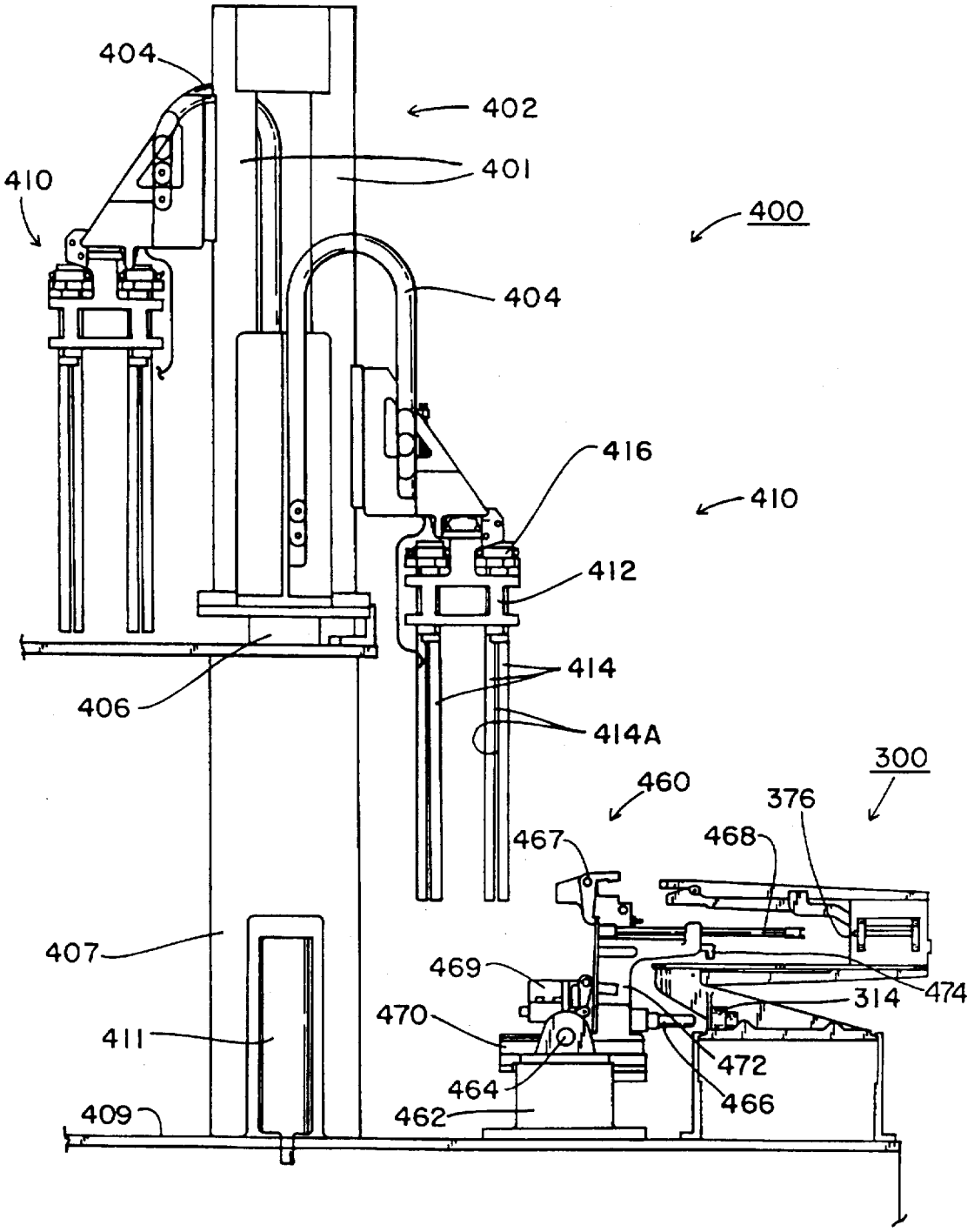
FIG. 5 is a side elevational view of a transfer station which forms a part of the present invention.
Figure 6:
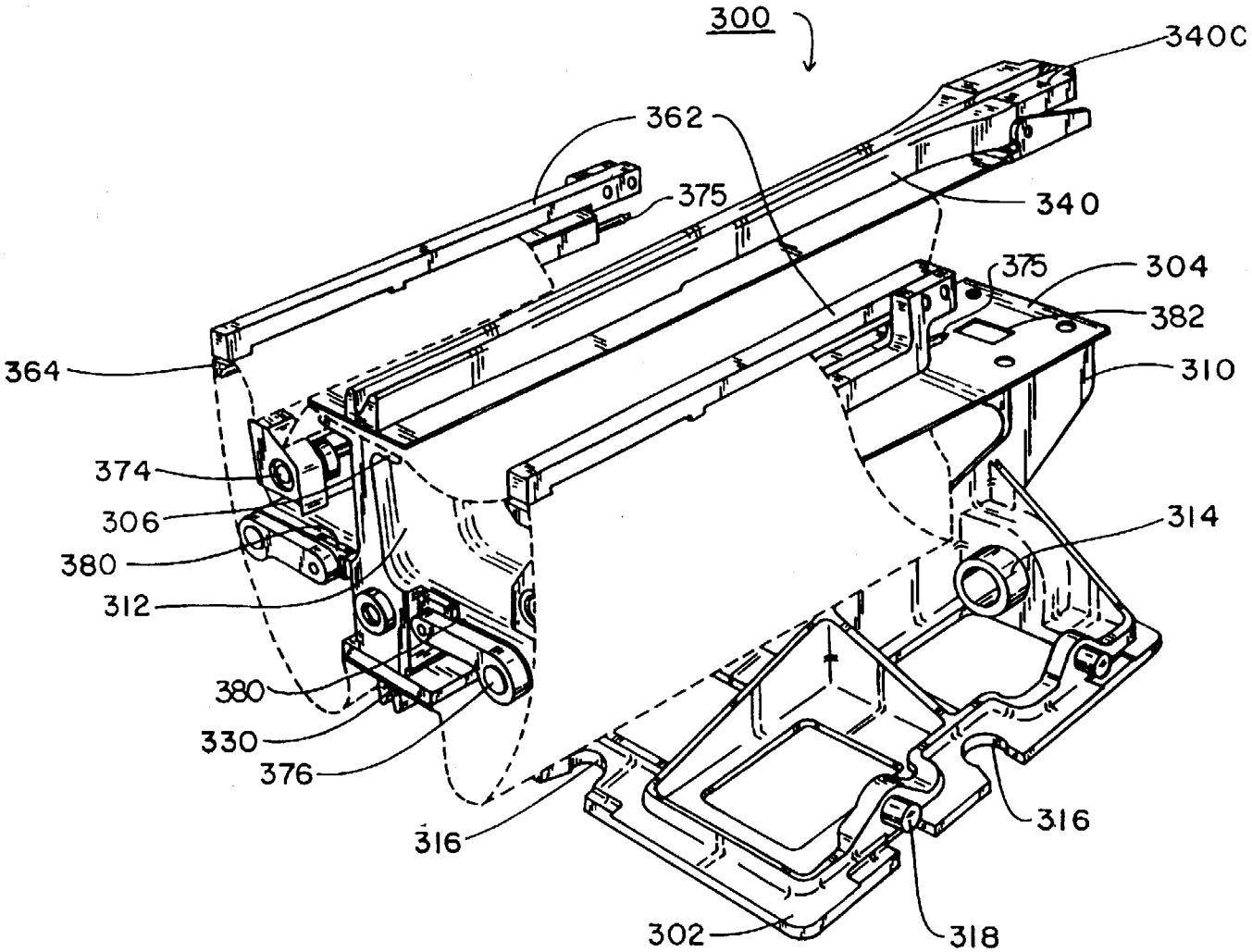
FIG. 6 is a perspective view of the combining fixture of the present invention with a brief, shown in dotted line form.

A fabric brief (combined front and back panels) is transferred from combining fixture 300 to clamp arms 414 as follows. Upstream conveyor 100 positions and raises fixture 300 in front of pivot assembly 460, as shown in FIG. 5. Pivot point 464 and base 470 slide forward so that pivot assembly 460 engages fixture 300. As pivot assembly 460 engages fixture 300, actuator rod 468 engages control rods 374 and engagement rods 466 enter transfer engagement bushings 314 and fixture latch 474 engages slot 382. Fixture 300 is then lifted to a vertical position by pivoting base 470 at pivot point 464.

Once fixture 300 is in the vertical position, retracted carriage 412 is lowered such that the clamp arms 414, which are in the open position, surround the brief. Carriage 412 then extends. Clamp arms 414 are now positioned such that each pair of opposed clamp arms has one clamp arm on the exterior circumference of the brief and one clamp arm on the interior circumference of the brief. The clamp arms are then put in the closed position by actuator means 416, so that each of the four sets of the clamp arms 414 is gripping the brief on a separate point along its circumference and fully along its length. Actuator rod 468, still engaged with control rods 374, is rotated, opening gripper arms 362 and 364 of fixture 300. Simultaneously, upper release actuator 467 is operated to press downwardly on upper pivot end 340C to raise upper clamp arm 340, and lower release actuator 469 is operated to press upwardly upon lower pivot end 330C to lower clamp arm 330. As a result of these operations, the brief which is now securely held by clamp arm 414, is released from fixture 300.

Lift assembly 410 is then raised vertically by powering brace 404 up track 401. Finally, lift assembly 410 and the brief it is holding are transferred to the opposite side of mast 402 by rotating mast 402 at rotational pivot 406. The brief can now be transferred to the binding fixture 600 for further operations or placed in a bin for shipping.

After the brief has been removed from fixture 300, fixture 300 is lowered back onto upstream conveyor 100 by reversing the lifting steps.

Binding Portion

Figure 7:
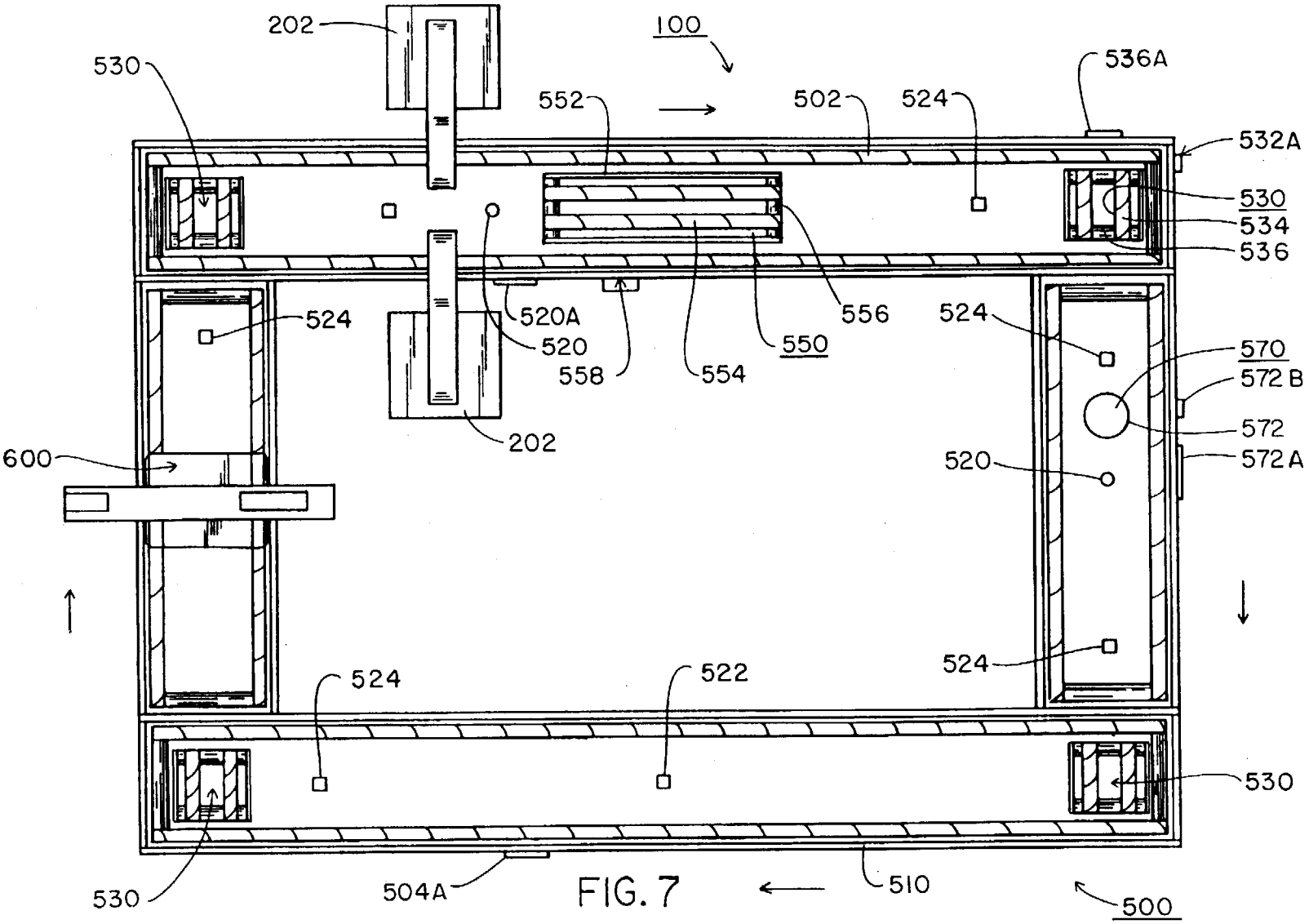
FIG. 7 is a plan view of the binding portion of a conveyor system constructed according to the present invention.

As best seen in FIG. 7, the binding portion of the apparatus of the present invention includes two basic subsystems: a downstream conveyor generally denoted by the numeral 500 and a binding fixture generally denoted by the numeral 600. Also forming a part of the invention is binding machine 202. While only this single work station is shown, the system of the present invention can easily be designed to accommodate many work stations.

Basic operation of the present invention is as follows. Fixture 600 rides along downstream conveyor 500. Work stations such as binding machine 202 are located along the path of downstream conveyor 500. As a garment mounted on fixture 600 passes by a work station, it is operated upon. Several features are provided to facilitate the flow of the fixture and the accuracy and efficiency of the operations including lift systems 530, rotators 570, stops 520, secondary conveyors 550, and sensor means 522 and 524. It is particularly noteworthy that a plurality of fixtures can be used at once, and therefore a plurality of garments can be fabricated simultaneously.

Downstream conveyor 500 has frame 510. Mounted on frame 510 are primary belts 502 which ride on a fluorocarbon plastic surface and are driven by primary drive means 504A. These drive means may be servo-controlled or conventional motors, for example, depending on the degree of control needed for the associated operations. Fixture 600, which will be discussed more fully later, has base 602 adapted to ride on downstream conveyor 500 and is guided by frame 510. In operation, fixture 600 travels in a clockwise direction. Lift systems 530 are provided to allow fixture 600 to pass around the corners of downstream conveyor 500 without interference with frame 510.

Lift systems 530 have lift belts 534 which travel on lift rollers 536 and are driven by lift motors 536A. Lift systems 530 also have lift supports which support the aforementioned lift system components and are operatively connected to pneumatic cylinders or motors 532A. When fixture 600 is positioned over a lift system 530, the cylinder or motor is actuated such that the lift support raises and meets the base of fixture 600. Driven lift belts 534 engage fixture 600 and push or pull (depending on whether the lift system is located at the entrance or the exit of the corner) fixture 600 over frame 510 and onto the adjacent primary belts 502. Position sensors 524 sense the presence of fixture 600 and can thereby provide associated software with the data necessary to determine when fixture 600 is in position to raise lift support 532.

Rotator 570 operates much like lift system 530. Position sensor 524 signals the position of fixture 600. Rotator support 572 is raised by a pneumatic cylinder 572B and rotated by a pneumatic actuator 572A. Depending on the desired position of fixture 600 for the next operation, fixture 600 may be rotated 90° or 180°.

When multiple fixtures are used or where speed sensitive operations are implemented, it will be advantageous to control the speed of each fixture. Stops 520 are provided to stop a fixture when desired. Stops 520 are actuated by a pneumatic cylinder 520A in the preferred embodiment and engage stop locator 612 formed in base 602 of fixture 600. Stops 520 can then be retracted to allow fixture 600 to resume travel. Secondary conveyors 550 are provided to either speed up or slow down fixtures on various portions of downstream conveyor 500.

Secondary belts 554 are driven by drive means 558 and ride on rollers 556 which are in turn mounted on secondary lift 552. A fixture traveling over a secondary lift is raised off the primary belts and as a result travels at the speed of the secondary belts. This is helpful to ensure a steady and appropriate speed at any given work station during operation, such as a binding machine.

Turning now to binding fixture 600, the same is shown in detail in FIGS. 8–11 and 13. Fixture 600 has base 602.

Stop locators 612 are formed in base 602. Platform 604 is formed on top of base 602.

Bumpers 610 are mounted on base 602 to protect fixture 600 in case of collisions with other fixtures. An identification badge 620 is affixed to the bottom of base 602 to provide information about the fixture and its associated garment to a scanning device. Identification badge 620 may be a bar code or an electrically encoded tab, for example. Sensor means 522 located on downstream conveyor 500 are designed to read whatever information has been encoded on the identification badge (for example, the size of the brief on the fixture).

Front assembly 630 and rear assembly 633 are supported by platform 604. In the preferred embodiment, front post 606 is fixedly mounted to platform 604 and rear post 608 is slidably mounted in track 683 which is formed in platform 604. Rear post 608 and rear assembly 633 may be locked in position by engaging lock teeth 685. Depressing lock release rod 684 will cause lock teeth 685 to disengage so that rear assembly 633 can be slidably readjusted. The importance of this adjustment mechanism will become apparent hereinafter.

Lower legs 654 are pivotally mounted to front and rear posts 606,608 at lower assembly pivots 650A. Lower clamp arms 650 are also pivotally mounted at lower assembly pivots 650A and are biased against lower legs 654 by springs. Lower clamp arms 650 may be pivoted away from lower legs 654 to achieve an open position by pushing lower clamp control levers 662 toward the center of platform 604. Slots 660 are formed in lower legs 654 and lower clamp arms 650 as shown.

Upper legs 656 are pivotally mounted to lower legs 654 at pivot points 670. Upper clamp arms 652 are pivotally mounted to upper legs 656 at pivot points 652A and are biased against upper legs 656 by magnets 690. Upper clamp arms 652 may be separated from upper legs 656 to achieve an open position by rotating actuator engagement slot 653.

Figure 8:
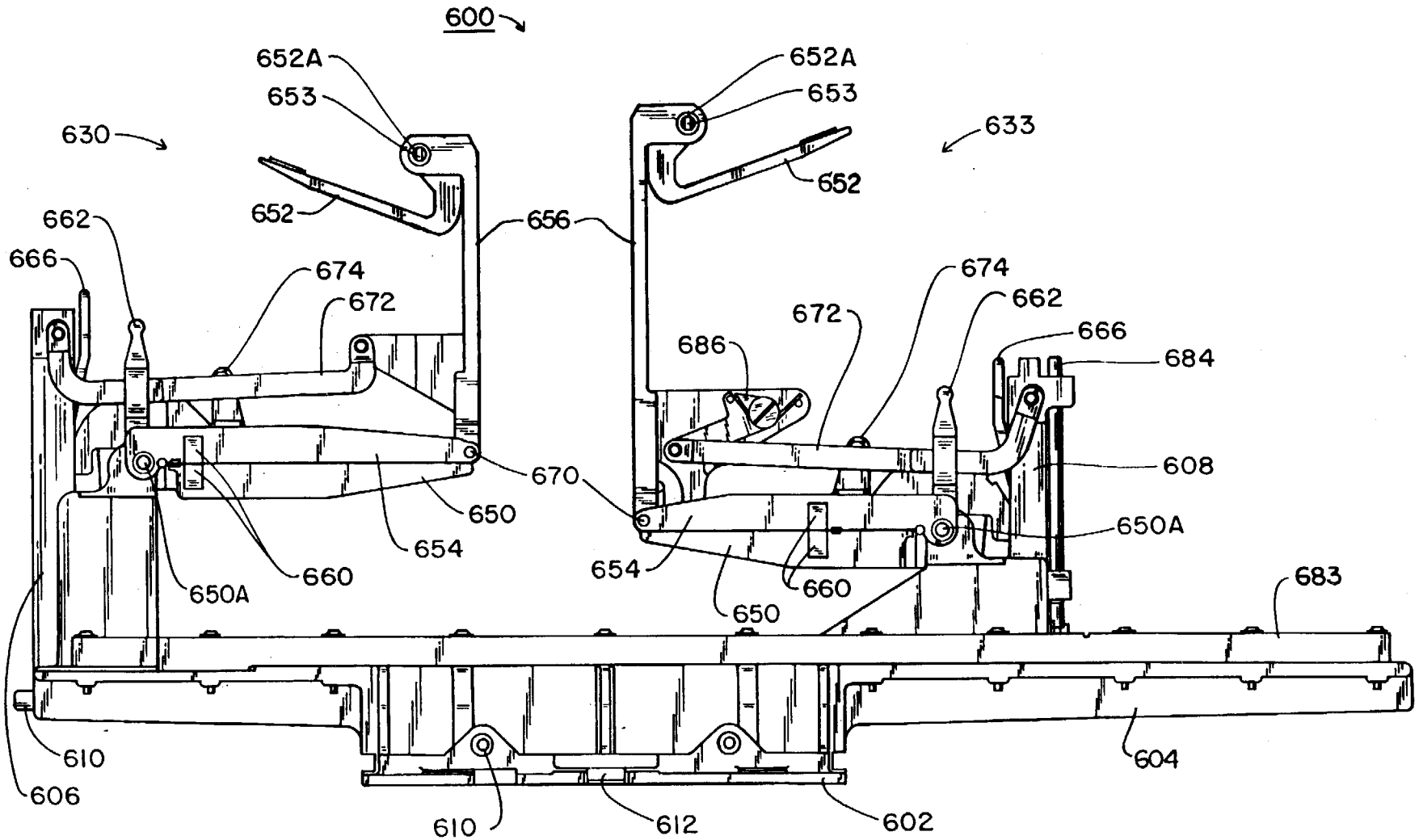
FIG. 8 is a side elevational view of a binding fixture of the present invention in the ready position.
Figure 9:
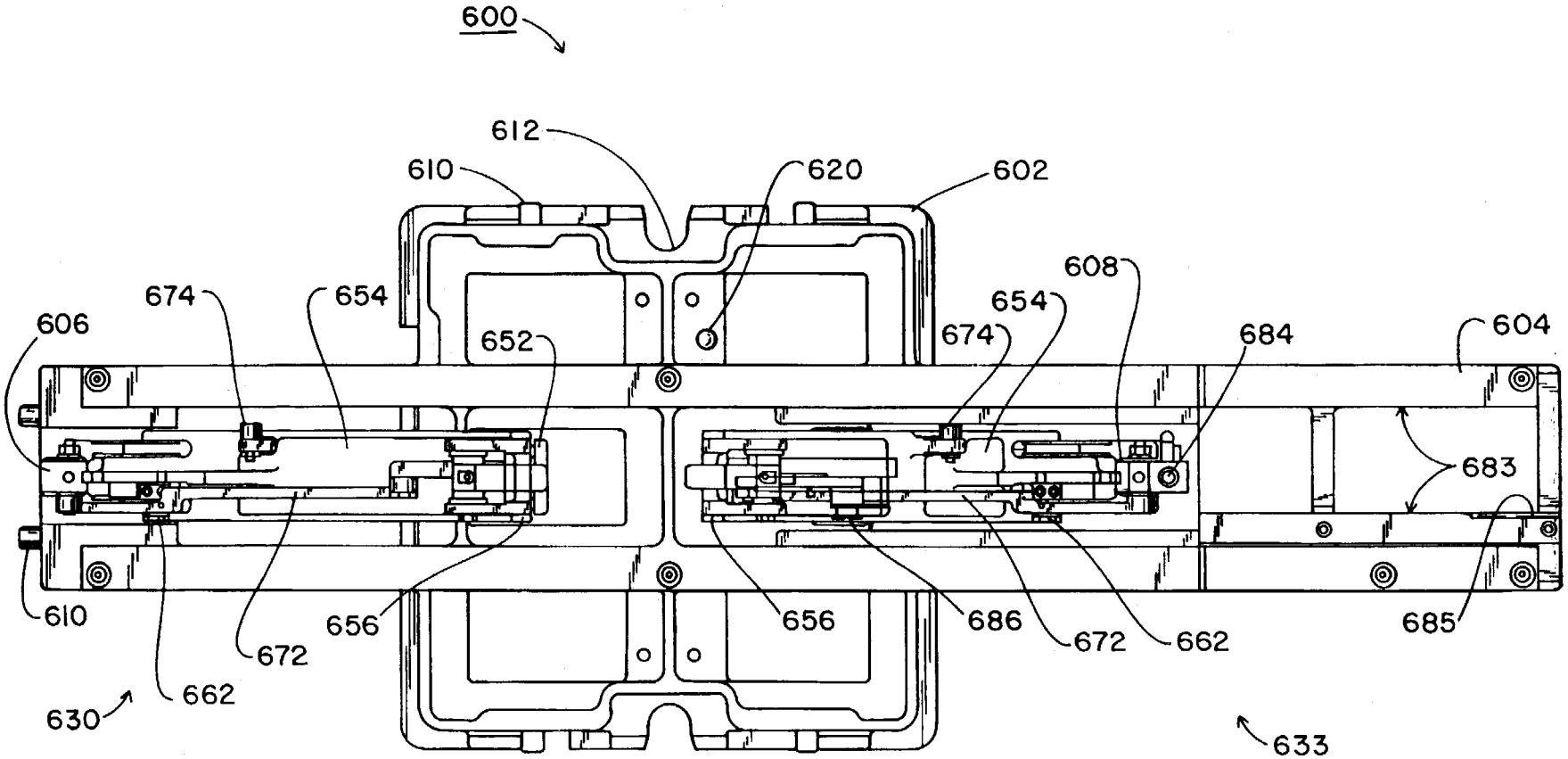
FIG. 9 is a top plan view of the binding fixture forming a part of the present invention in the ready position.
Figure 10:
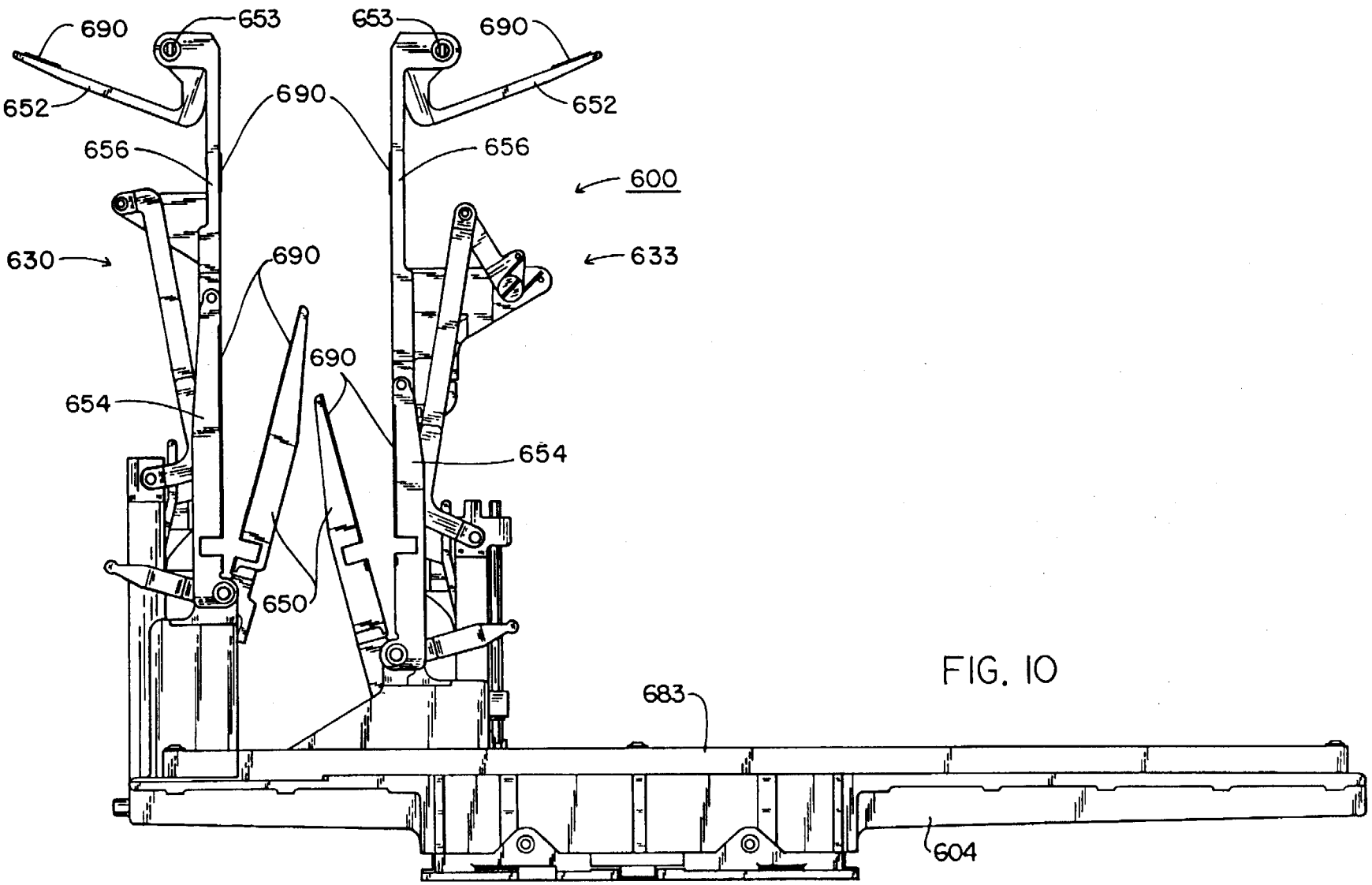
FIG. 10 is a side elevational view of the binding fixture forming a part of the present invention in the receiving position.
Figure 11:
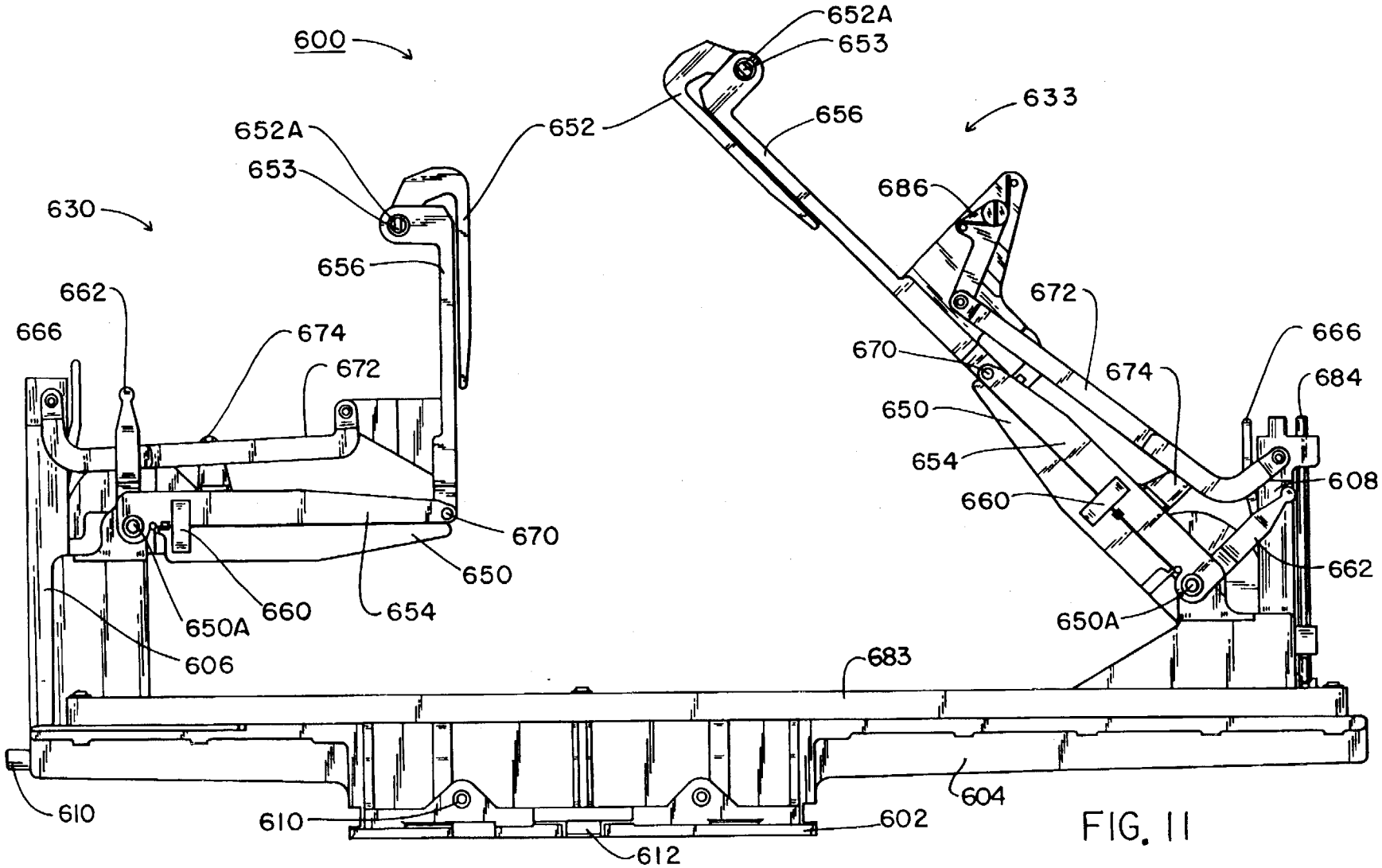
FIG. 11 is a side elevational view of the binding fixture of the present invention in the binding position.
Figure 12:
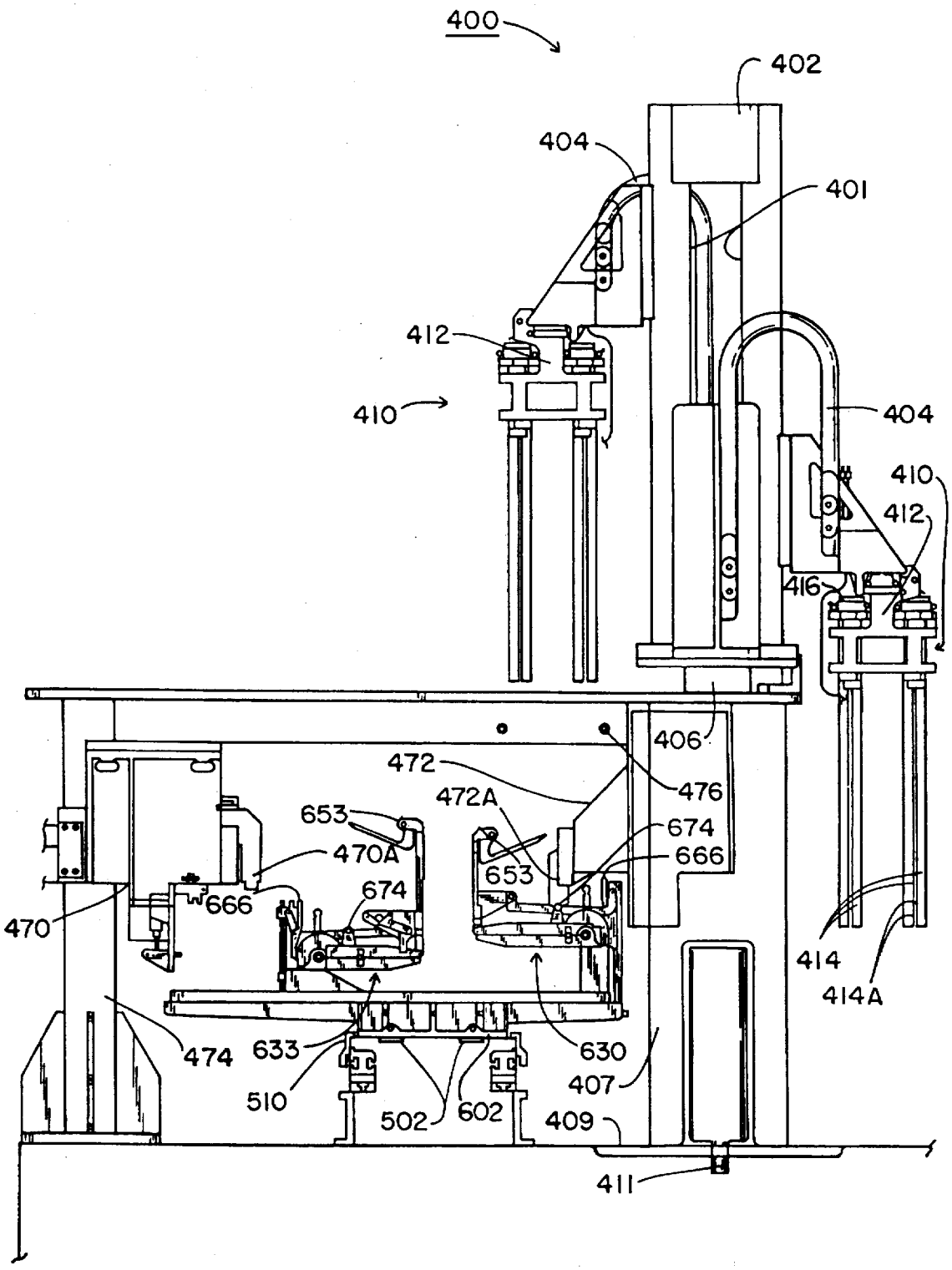
FIG. 12 is a side elevational view of a transfer station which forms a part of the present invention.
Figure 13:
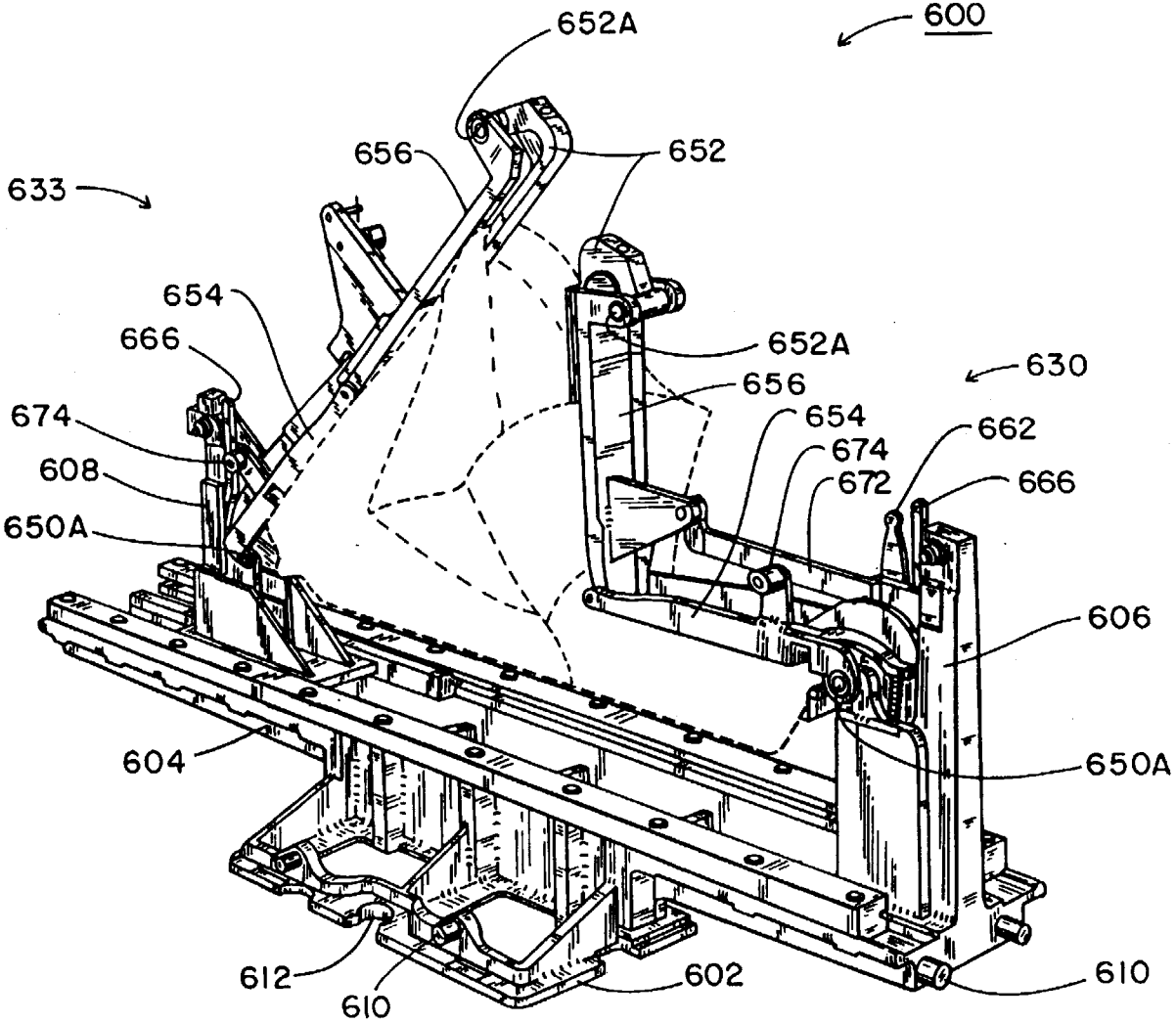
FIG. 13 is a perspective view of the binding fixture of the present invention holding a brief, shown in dotted line form.

Front and rear assemblies 630,633 are interconnected by linkages 672. In the preferred embodiment, a latch, not shown, locks the assemblies in the ready position shown in FIG. 8. Pushing release levers 666 disengages the latches. Assembly control means 674 is operatively connected to linkages 672 such that forcing the end of assembly control means 674 towards or away from the center of platform 604 will cause front and rear assemblies 630,633 to assume the positions shown in FIGS. 10 and 11. These positions will be more fully discussed hereinafter and are referred to as follows:

a. FIGS. 8 and 9 show the "ready" position, b. FIG. 10 shows the "receiving" position, c. FIGS. 11 and 13 show the "binding" position.

Tensioner spring assembly 686 biases the assemblies to remain in the binding position once they have been so disposed by actuating assembly control means 674.

The ready position is shown in FIGS. 8 and 9. In this position, upper clamp arms 652 are open and lower clamp arms 650 are in the closed position. Lower legs 654 are positioned at right angles to front and rear posts 606,608. Upper legs 656 are positioned at right angles to lower legs 654. Rear assembly 633 is positioned near the center of platform 604.

The receiving position is shown in FIG. 10. Upper and lower legs 654,656 are aligned and positioned vertically. Upper clamp arms 652 and lower clamp arms 650 are open. Rear assembly 633 is on the front end of platform 604.

The binding position is shown in FIGS. 11 and 13. In FIG. 13, the binding fixture is shown holding a brief (shown in dotted line form). Front assembly 630 is positioned the same as in the ready position. Rear assembly 633 is positioned somewhat rearward of platform 604 relative to its position in the ready position. The exact location will depend on the size of the brief to be held. Upper and lower legs 656,654 are aligned and positioned at approximately 45° angles to platform 604. Upper and lower clamp arms 652,650 are in the closed position.

The three positions of binding fixture 600 can best be understood in relation to the transfer station, generally denoted 400, forming a part of the present invention. In the preferred embodiment, the basic purpose of the transfer station when used to fabricate briefs is to place a garment comprising a combined front brief panel and back brief panel onto fixture 600 such that the critical edges are continuously located and accurately positioned.

As discussed above, transfer station 400 has mast 402. Mast 402 is mounted by rotational pivot 406 onto base 407, which is in turn fixedly mounted onto table 409. Rotator motor 411 is operatively connected to turn mast 402. Lift assemblies, denoted generally 410, are mounted on mast 402 by braces 404. Braces 404 are vertically slidable along track 401 formed in mast 402.

Lift assemblies 410 have carriages 412 formed thereon. Eight clamp arms 414 depend from each of carriages 412 in four sets of opposed pairs. Each clamp arm 414 has foam backing 414A located on the surface facing its opposing clamp arm 414. Clamp arm actuator means 416 mounted on carriages 412 are operatively connected to clamp arms 412 and are designed to move the same between an open position and a closed position. In the closed position, the foam backing 414A on each clamp arm 414 is pressed against the foam backing of the opposing clamp arm 414. In the open position, the clamp arms are separated.

A fabric brief (combined front and back panels) is transferred from clamp arms 414 to binding fixture 600 as follows. Note that the garment is generally tubular because the crotch seam has not yet been sewn. One end, hereinafter referred to as the top end, is basically circular. The opposite end, hereinafter referred to as the bottom end, has two arcuate cut-outs representing the leg holes of a completed brief.

Clamp arms 414 are initially positioned such that each pair of opposed clamp arms has one clamp arm on the exterior circumference of the brief and one clamp arm on the interior circumference of the brief. The clamp arms are in the closed position so that each of the four sets of the clamp arms 414 is gripping the brief on a separate point along its circumference and fully along its length, with the top end of the brief nearest the carriage and the free ends of the clamp arms extending out of the bottom end of the brief.

Lift assembly 414 is initially disposed on the side of mast 402 opposite binding downstream conveyor 500.

Lift assembly 410 and the brief it is holding are transferred to the opposite side of mast 402 by rotating mast 402 at rotational pivot 406. Lift assembly 410 is then lowered vertically by powering brace 404 down track 401.

Binding fixture 600 is initially in the ready position. When downstream conveyor 500 positions fixture 600 in front of transfer station 400, stop 520 raises and holds the fixture in place. Next, rear assembly positioning means 470 and front assembly positioning means 472 slide outwardly from support 474 and base 407, respectively, to engage fixture 600.

Rear assembly positioning means 470 engages lock release 684 and pushes rear assembly 633 along tracks 683 in the direction of mast 402. At the same time, rear assembly positioning means 470 engages release lever 666 and U-shaped slot 470A engages assembly control means 674. Simultaneously and in coordination, U-shaped slot 472A of front assembly positioning means 472 engages and pushes assembly control means 674 of front assembly 630. As assembly control means 674 are pushed forward or rearward by U-shaped slots 470A,472A, linkages 672 cause upper and lower legs 654,656 to assume the receiving position. Rear and front assembly position means 470,472 then force lower clamp control levers 662 upward causing lower clamp arms 650 to open. Clamp actuator means 476 then engage actuator engagement slots 653 of upper clamp pivots 652A and rotate the same.

Upon completion of the above steps, fixture 600 is positioned beneath carriage 412 in the receiving position. Carriage 412 is then lowered vertically down track 401 until assemblies 633,630 are flanked by two sets of clamp arms 414 on each side and the top edge of the brief, still held by clamp arms 414, is approximately level with the top ends of upper legs 656. The crotch portions of the brief (that is, the fabric strips between the leg cut-outs) are disposed between lower legs 654 and lower clamp arms 650.

Next, lower clamp control levers 662 are released by assembly positioning means 470,472 and upper clamp pivots 652A are rotated by clamp actuator means 476. As a result, the brief is captured securely by the upper and lower clamps of fixture 600. Clamp arms 414 of the transfer station are then opened and carriage 412 is raised.

Rear assembly positioning means 470 then forces rear assembly 633 of fixture 600 into the binding position via U-shaped slot 670A. Assembly positioning means 470,472 are then retracted. Fixture 600 remains in the binding position due to tensioner spring assembly 686 and latch 666.

The brief is now held such that the leg cut-outs are held straight, as shown in FIG. 13. In this position, all of the critical edges for binding are accurately located, firmly secured and held such that binding can be applied to the leg holes using a conventional binding apparatus 202. Once the binding has been applied, the brief can be removed by returning fixture 600 to a ready position, opening the upper and lower clamps, and pulling the brief out of the fixture. This may be done manually or robotically.

Certain modifications and improvements will occur to those skilled in the art upon a reading of the foregoing disclosure. It should be understood that all such modifications and improvements have been deleted herein for the sake of conciseness and readability, but are properly in the scope of the following claims.

We claim:

1. A combining and binding conveyor system for combining a first fabric piece and a second fabric piece to form a combined fabric piece and to apply a binding to an edge of the combined fabric piece, said system comprising:

(a) a combining fixture having means for holding said first fabric piece and said second fabric piece;

(b) an upstream conveyor for transporting said combining fixture;

(c) at least one work station having means for combining said first and second fabric pieces;

(d) a binding fixture for holding said fabric piece;

(e) a downstream conveyor for transporting said binding fixture; and (f) at least one work station located adjacent to said downstream conveyor for attaching said binding to said edge of said combined fabric piece while the same is being held by said binding fixture.

2. The combining and binding conveyor system of claim 1 further including a transfer station for removing said combining fixture from said upstream conveyor and for placing said combined fabric piece on said binding fixture.

3. The combining and binding conveyor system of claim 2 wherein said transfer station includes:

(a) engaging means for engaging said combining fixture;

(b) a tilt actuator; and (c) means for removing said combined fabric piece from said combining fixture.

4. The combining and binding conveyor system of claim 3 wherein said engaging means for engaging said combining fixture includes one or more rods and one or more holes adapted to receive said rods.

5. The combining and binding conveyor system of claim 4 wherein said tilt actuator is operative to selectively move said engaging means, and thereby said combining fixture when the same is engaged with said engaging means, between a first position and a second position.

6. The combining and binding conveyor system of claim 5 wherein the angle between said first position and said second position is about 90°.

7. The combining and binding conveyor system of claim 3 wherein said means for removing said combined fabric piece includes a plurality of clamps and a clamp actuator.

8. The combining and binding conveyor system of claim 7 wherein said plurality of clamps and said clamp actuator are selectively moveable between a first unclamped position and a second clamped position.

9. The combining and binding conveyor system of claim 2 wherein said transfer station includes transport means for transporting said combined fabric piece and holding means for holding said combined fabric piece, wherein said holding means is attached to said transport means.

10. The combining and binding conveyor system of claim 9 wherein said transport means includes a housing fixture attached to said holding means and a housing fixture actuator for moving said housing fixture.

11. The combining and binding conveyor system of claim 10 wherein said housing fixture actuator is selectively moveable between a first position and a second position.

12. The combining and binding conveyor system of claim 9 wherein said holding means includes a plurality of clamps and a clamp actuator.

13. The combining and binding conveyor system of claim 12 wherein said clamp actuator is selectively moveable between a first open position for releasing said combined fabric piece and a second closed position for securing said combined fabric piece.

14. The combining and binding conveyor system of claim 1 wherein each of said upstream and downstream conveyors includes:

(a) a support frame;

(b) at least one belt attached to said frame for transporting one of said combining and binding fixtures; and (c) drive means for driving said belt.

15. The combining and binding conveyor system of claim 14 wherein said support frame is generally rectangular having four adjacent legs.

16. The combining and binding conveyor system of claim 15 further including transfer means for transferring each of said combining and binding fixtures from one leg of said rectangular support frame to an adjacent leg of said rectangular support frame.

17. The combining and binding conveyor system of claim 16 wherein said transfer means includes:

(a) lift means for lifting each of said combining and binding fixtures;

(b) belt means attached to said lift means for transporting each of said combining and binding fixtures; and (c) drive means for driving said belt means.

18. The combining and binding conveyor system of claim 14 wherein said belt means include a primary belt means for transporting said fixture at one speed and a secondary belt means for transporting each of said combining and binding fixtures at a different speed.

19. The combining and binding conveyor system of claim 18 further including lift means to lift said secondary belt means above said primary belt means such that each of said combining and binding fixtures is supported and transported by said secondary belt means.

20. The combining and binding conveyor system of claim 1 wherein one of said work stations is a sewing machine for sewing together said first fabric piece and said second fabric piece to form said combined fabric piece.

21. The combining and binding conveyor system of claim 1 wherein one of said work stations is a binding machine for applying binding to said fabric piece.

22. A combining and binding conveyor system for combining a first fabric piece and a second fabric piece to form a combined fabric piece and to apply a binding to an edge of the fabric piece, said system comprising:

(a) a combining fixture having means for holding said first fabric piece and said second fabric piece; said combining fixture including: (i) a base; (ii) fabric clamping means for receiving and securing said first fabric piece; and (iii) a support attached to said base and supporting said fabric clamping means;

(b) an upstream conveyor for transporting said combining fixture;

(c) at least one work station having means for combining said first and second fabric pieces;

(d) a binding fixture for holding said combined fabric piece;

(e) a downstream conveyor for transporting said binding fixture;

(f) at least one work station located adjacent to said downstream conveyor for attaching said binding to said edge of said fabric piece while the same is being held by said binding fixture; and (g) a transfer station for removing said combining fixture from said upstream conveyor and for placing said fabric piece on said binding fixture on said downstream conveyor.

23. The combining and binding conveyor system of claim 22 wherein said transfer station includes:

(a) engaging means for engaging said combining fixture;

(b) a tilt actuator; and (c) means for removing said combined fabric piece from said combining fixture.

24. The combining and binding conveyor system of claim 23 wherein said engaging means for engaging said combining fixture includes one or more rods and one or more holes adapted to receive said rods.

25. The combining and binding conveyor system of claim 24 wherein said tilt actuator is operative to selectively move said engaging means, and thereby said combining fixture when the same is engaged with said engaging means, between a first position and a second position.

26. The combining and binding conveyor system of claim 25 wherein the angle between said first position and said second position is about 90°.

27. The combining and binding conveyor system of claim 23 wherein said means for removing said combined fabric piece includes a plurality of clamps and a clamp actuator.

28. The combining and binding conveyor system of claim 27 wherein said plurality of clamps and said clamp actuator are selectively moveable between a first unclamped position and a second clamped position.

29. The combining and binding conveyor system of claim 22 wherein said transfer station includes transport means for transporting said combined fabric piece and holding means for holding said combined fabric piece, wherein said holding means is attached to said transport means.

30. The combining and binding conveyor system of claim 29 wherein said transport means includes a housing fixture attached to said holding means and a housing fixture actuator for moving said housing fixture.

31. The combining and binding conveyor system of 30 wherein said housing fixture actuator is selectively moveable between a first position and a second position.

32. The combining and binding conveyor system of claim 29 wherein said holding means includes a plurality of clamps and a clamp actuator.

33. The combining and binding conveyor system of claim 32 wherein said clamp actuator is selectively moveable between a first open position for releasing said combined fabric piece and a second closed position for securing said combined fabric piece.

34. The combining and binding conveyor system of claim 22 wherein each of said upstream and downstream conveyors includes:

(a) a support frame;

(b) at least one belt attached to said frame for transporting one of said combining and binding fixtures; and (c) drive means for driving said belt.

35. The combining and binding conveyor system of claim 34 wherein said support frame is generally rectangular having four adjacent legs.

36. The combining and binding conveyor system of claim 35 further including transfer means for transferring each of said combining and binding fixtures from one leg of said rectangular support frame to an adjacent leg of said rectangular support frame.

37. The combining and binding conveyor system of claim 36 wherein said transfer means includes:

(a) lift means for lifting each of said combining and binding fixtures;

(b) belt means attached to said lift means for transporting each of said combining and binding fixtures; and (c) drive means for driving said belt means.

38. The combining and binding conveyor system of claim 34 wherein said belt means include a primary belt means for transporting said fixture at one speed and a secondary belt means for transporting each of said combining and binding fixtures at a different speed.

39. The combining and binding conveyor system of claim 38 further including lift means to lift said secondary belt means above said primary belt means such that each of said combining and binding fixtures is supported and transported by said secondary belt means.

40. The combining and binding conveyor system of claim 22 wherein one of said work stations is a sewing machine for sewing together said first fabric piece and said second fabric piece to form said combined fabric piece.

41. The combining and binding conveyor system of claim 22 wherein one of said work stations is a binding machine for applying binding to said combined fabric piece.

42. The combining fixture of claim 22 wherein said base is square shaped.

43. The combining fixture of claim 22 wherein said combining fixture further includes sensor means for determining the relative position of said combining fixture to said conveyor.

44. The combining fixture of claim 22 wherein said combining fixture further includes bumper means.

45. The combining fixture of claim 22 wherein said combining fixture further includes identification means.

46. The combining fixture of claim 44 wherein said identification means includes an encoded badge located on said combining fixture, and wherein said combining conveying system further includes means for inputting messages from said encoded badge.

47. The combining fixture of claim 22 wherein said fabric clamping means includes:

(a) a support;

(b) a control arm clamp attached to said support; and (c) at least one gripping arm.

48. The combining fixture of claim 22 wherein said control arm clamp is a cantilever.

49. The combining fixture of claim 48 wherein said cantilever control arm clamp is a biased member.

50. The combining fixture of claim 49 wherein said cantilever control arm clamp is a spring biased member.

51. The combining fixture of claim 22 wherein said gripping arm is selectively moveable between a first horizontal position and a second vertical position.

52. The combining fixture of claim 22 wherein said gripping arm has at least one set of parallel clamps for receiving and securing said first fabric piece, said second fabric piece, or said combined fabric piece.

53. The combining fixture of claim 52 wherein said parallel clamps are biased to a closed position.

54. The combining fixture of claim 53 wherein said parallel clamps are spring biased to a closed position.

55. The combining fixture of claim 22 wherein said support includes a cantilever arm which extends back over said base.

56. The combining fixture of claim 22 wherein said clamping means are selectively moveable between a first receiving position and a second securing position and include means for operatively engaging an actuating means for manipulating said fabric clamping means between said first receiving position and said second securing position.

57. A combining and binding conveyor system for combining a first fabric piece and a second fabric piece to form a combined fabric piece and to apply a binding to an edge of the combined fabric piece, said system comprising:

(a) a combining fixture having means for holding said first fabric piece and said second fabric piece;

(b) an upstream conveyor for transporting said combining fixture;

(c) at least one work station having means for combining said first and second fabric pieces;

(d) a binding fixture for holding said combined fabric piece, said binding fixture including: (i) a base; (ii) a support attached to said base; and (iii) fabric engaging means mounted on said support for engaging, positioning and securing said combined fabric piece;

(e) a downstream conveyor for transporting said binding fixture;

(f) at least one work station located adjacent to said downstream conveyor for attaching said binding to said edge of said combined fabric piece while the same is being held by said binding fixture; and (g) a transfer station for removing said combining fixture from said upstream conveyor and for placing said combined fabric piece on said binding fixture.

58. The combining and binding conveyor system of claim 57 wherein said transfer station includes:

(a) engaging means for engaging said combining fixture;

(b) a tilt actuator; and (c) means for removing said combined fabric piece from said combining fixture.

59. The combining and binding conveyor system of claim 58 wherein said engaging means for engaging said combining fixture includes one or more rods and one or more holes adapted to receive said rods.

60. The combining and binding conveyor system of claim 59 wherein said tilt actuator is operative to selectively move said engaging means, and thereby said fixture when the same is engaged with said engaging means, between a first position and a second position.

61. The combining and binding conveyor system of claim 60 wherein the angle between said first position and said second position is about 90°.

62. The combining and binding conveyor system of claim 58 wherein said means for removing said combined fabric piece includes a plurality of clamps and a clamp actuator.

63. The combining and binding conveyor system of claim 62 wherein said plurality of clamps and said clamp actuator are selectively moveable between a first unclamped position and a second clamped position.

64. The combining and binding conveyor system of claim 57 wherein said transfer station includes transport means for transporting said combined fabric piece and holding means for holding said combined fabric piece, wherein said holding means is attached to said transport means.

65. The combining and binding conveyor system of claim 64 wherein said transport means includes a housing fixture attached to said holding means and a housing fixture actuator for moving said housing fixture.

66. The combining and binding conveyor system of claim 65 wherein said housing actuator is selectively moveable between a first position and a second position.

67. The combining and binding conveyor system of claim 64 wherein said holding means includes a plurality of clamps and a clamp actuator.

68. The combining and binding conveyor system of claim 67 wherein said clamp actuator is selectively moveable between a first open position for releasing said combined fabric piece and a second closed position for securing said combined fabric piece.

69. The combining and binding conveyor system of claim 57 wherein each of said upstream and downstream conveyors includes:

(a) a support frame;

(b) at least one belt attached to said frame for transporting one of said combining and binding fixtures; and (c) drive means for driving said belt.

70. The combining and binding conveyor system of claim 69 wherein said support frame is generally rectangular having four adjacent legs.

71. The combining and binding conveyor system of claim 70 further including transfer means for transferring each of said combining and binding fixtures from one leg of said rectangular support frame to an adjacent leg of said rectangular support frame.

72. The combining and binding conveyor system of claim 71 wherein said transfer means includes:

(a) lift means for lifting each of said combining and binding fixtures means;

(b) belt means attached to said lift means for transporting each of said combining and binding fixtures; and (c) drive means for driving said belt means.

73. The combining and binding conveyor system of claim 69 wherein said belt means include a primary belt means for transporting each of said combining and binding fixtures at one speed and a secondary belt means for transporting each of said combining and binding fixtures at a different speed.

74. The combining and binding conveyor system of claim 73 further including lift means to lift said secondary belt means above said primary belt means such that each of said combining and binding fixtures is supported and transported by said secondary belt means.

75. The combining and binding conveyor system of claim 57 wherein one of said Work stations is a sewing machine for sewing together said first fabric piece and said second fabric piece to form said combined fabric piece.

76. The combining and binding conveyor system of claim 57 wherein one of said work stations is a binding machine for applying binding to said fabric piece.

77. The binding fixture of claim 57 wherein said base is square shaped.

78. The binding fixture of claim 57 wherein said binding fixture further includes sensor means for determining the relative position of said binding fixture to said downstream conveyor.

79. The binding fixture of claim 57 wherein said binding fixture further includes bumper means.

80. The binding fixture of claim 57 wherein said binding fixture further includes identification means.

81. The binding fixture of claim 80 wherein said identification means includes an encoded badge located on said binding fixture, and wherein said binding fixture further includes means for inputting messages from said encoded badge.

82. The binding fixture of claim 57 wherein said fabric engaging means includes:

(a) clamping means attached to said support; and (b) adjustment means for adjusting said combined fabric piece to a plurality of horizontal and vertical positions when engaged.

83. The binding fixture of claim 82 wherein said clamping means has a first opened position for receiving said combined fabric piece and a second closed position for securing said combined fabric piece, and wherein said clamping means includes actuator means for selectively moving said clamping means between said first open position and said second closed position.

84. The binding fixture of claim 83 wherein said actuator means includes means for operatively receiving a clamp control means such that input from said clamp control means selectively determines the position, open or closed, of said clamping means.

85. The binding fixture of claim 82 wherein said adjustment means includes means for adjusting the horizontal position of said combined fabric piece when the same is engaged.

86. The binding fixture of claim 82 wherein said adjustment means includes means for adjusting the vertical position of said combined fabric piece when the same engaged.

87. The binding fixture of claim 82 wherein said adjustment means includes means for adjusting the angular position of said combined fabric piece when the same is engaged.

88. The binding fixture of claim 82 wherein said adjustment means includes actuator means for adjusting said adjustment means between a plurality of positions.

89. The binding fixture of claim 88 wherein said adjustment means further includes means for operatively receiving an adjustment control means such that input from said adjustment control means selectively determines the position of said adjustment means.

90. The binding fixture of claim 57 wherein said support includes a first post and a second post, and wherein said first post and said second post are independent and moveable relative to one another.

91. The binding fixture of claim 90 wherein said adjustment means includes size adjustment means for adjusting the distance between said first post and said second post to adjust for different size fabric pieces.

92. The binding fixture of claim 91 wherein said size adjustment means includes locking means for locking said first post and said second post into position relative to each other.

93. A combining and binding conveyor system for combining a first fabric piece and a second fabric piece to form a combined fabric piece and to apply a binding to an edge of the fabric piece, said system comprising:

(a) a combining fixture having means for holding said first fabric piece and said second fabric piece; said combining fixture including: a base; fabric clamping means for receiving and securing said first fabric piece, wherein said fabric clamping means includes: (i) a support; (ii) a control arm clamp attached to said support; and (iii) at least one gripping arm; and a support attached to said base and supporting said fabric clamping means;

(b) an upstream conveyor for transporting said combining fixture;

(c) at least one work station having means for combining said first and second fabric pieces;

(d) a binding fixture for holding said combined fabric piece, said binding fixture including: a base; a support attached to said base; and fabric engaging means mounted on said support for engaging, positioning and securing said combined fabric piece, wherein said fabric engaging means includes: (i) clamping means attached to said support; (ii) adjustment means for adjusting said combined fabric piece to a plurality of horizontal and vertical positions when engaged; and (iii) actuator means for adjusting said adjustment means between said plurality of positions;

(e) a downstream conveyor for transporting said binding fixture;

(f) at least one work station located adjacent to said downstream conveyor for attaching said binding to said edge of said combined fabric piece while the same is being held by said binding fixture; and (g) a transfer station for removing said combining fixture from said upstream conveyor and for placing said combined fabric piece on said binding fixture.

* * * * *